United States Patent [19]

Howlett

[11] Patent Number: 4,858,790

[45] Date of Patent: Aug. 22, 1989

[54] COLLAPSIBLE CHAMBER METERING VALVE

[75] Inventor: David J. Howlett, Norfolk, United Kingdom

[73] Assignee: Bespak PLC, King's Lynn, England

[21] Appl. No.: 236,398

[22] Filed: Aug. 25, 1988

[30] Foreign Application Priority Data

Sep. 7, 1987 [GB] United Kingdom ..... 8720978

[51] Int. Cl.[4] ..... B65D 83/14

[52] U.S. Cl. ..... 222/402.2; 222/402.24; 251/342

[58] Field of Search ..... 222/402.2, 402.24; 251/354, 342, 348

[56] References Cited

U.S. PATENT DOCUMENTS

| | | | |
|---|---|---|---|
| 3,185,356 | 5/1965 | Venus . | |
| 3,813,013 | 5/1974 | Kotuby et al. | 222/402.24 |
| 4,744,495 | 5/1988 | Warby | 222/402.2 |

FOREIGN PATENT DOCUMENTS

| | | |
|---|---|---|
| 872187 | 7/1961 | United Kingdom . |
| 1327800 | 8/1973 | United Kingdom . |
| 2050303 | 3/1983 | United Kingdom . |

*Primary Examiner*—H. Grant Skaggs

*Attorney, Agent, or Firm*—Beveridge, DeGrandi & Weilacher

[57] ABSTRACT

A collapsible chamber metering valve for use in a pressurized dispensing container 2 comprises a generally cylindrical body 3, an elastomeric sleeve 12 coaxially overlaying the body and defining a collapsible chamber 14 therebetween, the body defining an internal chamber 18, channel means 31 providing a fluid flowpath between the internal chamber and the collapsible chamber, an axially slidable valve actuating stem 6 extending coaxially through the internal chamber, outlet valve means 33 operable between the stem and the body at the outer end of the internal chamber so as to dispense fluid therefrom in an open condition of the valve and inlet valve means 21 operable between the body and the stem at the inner end of the internal chamber to admit fluid thereto in a closed condition of the valve wherein the inlet valve means comprises an annular seal portion 29 of the sleeve cooperating with an inner end portion 8 of the stem extending therethrough and wherein the sleeve further comprises an annular shoulder portion 16 nestably receiving the inner end 15 of the body, the shoulder portion and the seal portion being integrally formed of relatively thick and thin material respectively whereby the shoulder portion and seal portion are relatively rigid and flexible respectively so as to positively locate the sleeve upon the valve body while permitting deformation of the seal portion.

4 Claims, 2 Drawing Sheets

COLLAPSIBLE CHAMBER METERING VALVE

This invention relates to collapsible chamber metering valves of the type in which an elastomeric sleeve overlays a valve body to define a collapsible chamber therebetween.

A problem exists with existing valves of this type in that the complex shapes of valve components required presents difficulties in moulding from plastics materials and also the number of components involved requires complex assembley procedures. Consequently such valves have been uneconomic to produce.

According to the present invention there is disclosed a collapsible chamber metering valve for use in a pressurised dispensing container comprising a generally cylindrical body, an elastomeric sleeve coaxially overlaying the body and defining a collapsible chamber therebetween, the body defining an internal chamber, channel means providing a fluid flowpath between the internal chamber and the collapsible chamber, an axially slidable valve actuating stem extending coaxially through the internal chamber, outlet valve means operable between the stem and the body at the outer end of the internal chamber so as to dispense fluid therefrom in an open condition of the valve and inlet valve means operable between the sleeve and the stem at the inner end of the collapsible chamber to admit fluid thereto in a closed condition of the valve, wherein the inlet valve means comprises an annular seal portion of the sleeve cooperating with an inner end portion of the stem extending therethrough and wherein the sleeve further comprises an annular shoulder portion integrally formed of relatively thick and thin material respectively whereby the shoulder portion and seal portion are relatively rigid and flexible respectively so as to positively locate the sleeve upon the valve body whilst permitting deformation of the seal portion.

(The terms inner and outer unless otherwise specified are used to indicate axial directions which are inward or outward with respect to the container respectively).

An advantage of such an arrangement is that the sleeve and the seal portion are integrally formed thereby reducing the number of components. In addition the flexibility of the seal portion allows manufacturing tolerances to be relaxed with respect to the relative positions of the stem and the seal portion. A further advantage is that the rigidity of the shoulder portion and the manner in which it is positively located in a static position on the body results in a high degree of isolation being achieved between the flexible seal portion and the relatively flexible sidewalls of the sleeve which define the collapsible chamber. The sidewalls, the shoulder portion and the seal portion may therefore be integrally formed without the disadvantage of interaction in the operation of the inlet valve means and the collapsible chamber. A further advantage is that the sleeve is readily mouldable in a single simple operation.

Preferably the seal further comprises a radially outwardly extending annular flange at its outer axial extremity, which flange provides sealing gasket means in use between a similarly extending flange of the body and a rim of the container.

An advantage of such an arrangement is that the need for a separate gasket component is obviated. This arrangement also simplifies assembly because the sleeve, the body and the container rim may be nestably located and connected together by the addition of a crimped valve ferrule to form a fluid tight seal between the body and the container rim.

Preferably the channel means comprises a slot in the body extending axially from the inner end of the body into communication with the collapsible chamber, at least the inner end portion of the slot extending radially into the internal chamber to provide a flowpath between the collapsible chamber and a location in the internal chamber adjacent to the inlet valve means.

An advantage of such a slot is that the flowpath provided enables the collapsible chamber to be refilled with fluid passing through the inlet valve means directly into the collapsible chamber via the slot when the valve is in the closed condition. This arrangement is distinguished from prior art arrangements in which the refill flowpath takes an indirect path from the inlet valve means, along the length of the internal chamber and then through an access port into the collapsible chamber. The present invention thereby provides faster refilling of the collapsible chamber. A further advantage is that the slot is readily moulded as a feature of the body since it does not require the use of radially moving moulding tools.

Preferably the seal portion of the sleeve comprises a tubular projection having a radially inwardly directed annular rib of part circular cross section.

An advantage of such a rib is that friction between the seal portion and the stem is reduced to thereby providing smoothness of operation.

Particular embodiments on the invention will now be described by way of example only and with reference to the accompanying drawings of which;

Figure 1:
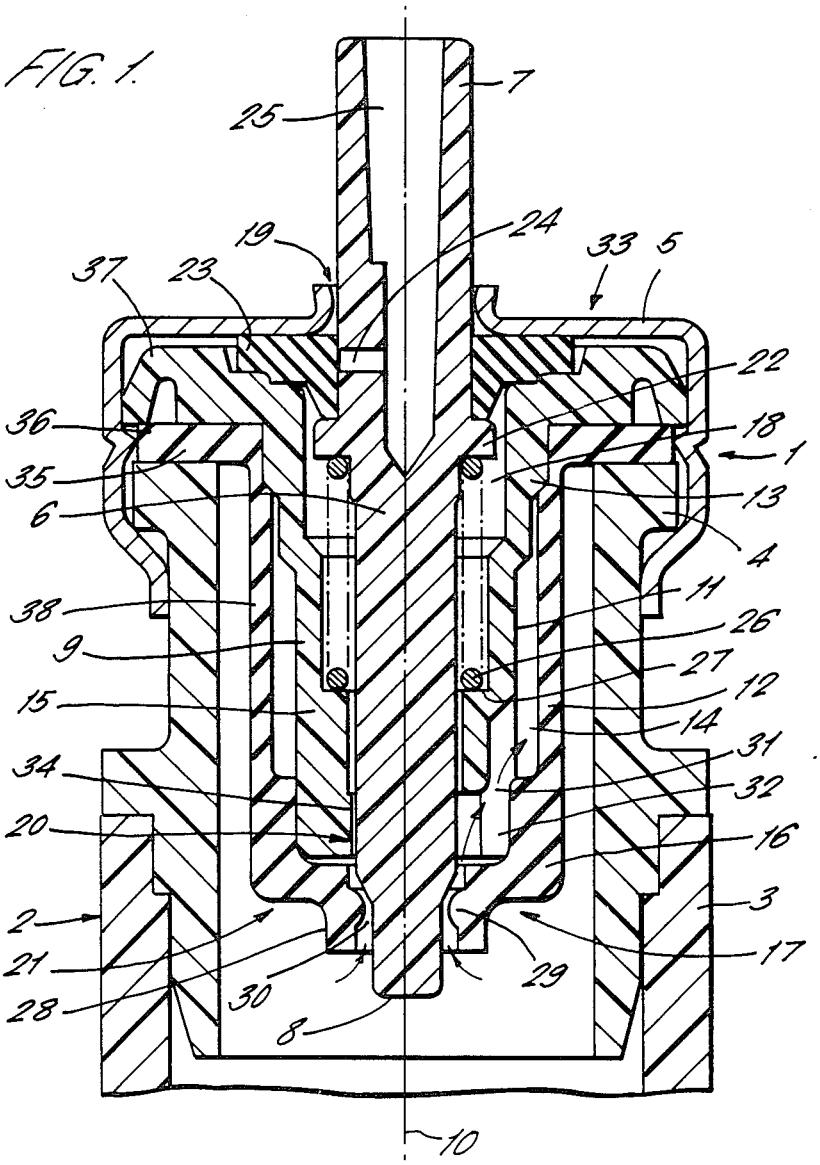
FIG. 1 is a sectional elevation of a collapsible chamber metering valve in the closed condition.

The valve 1 of FIG. 1 is shown in combination with a pressurised dispensing container 2 having a cylindrical container body 3. The valve 1 is held in place on a rim 4 of the container body 3 by means of a crimped valve ferrule 5.

A valve stem 6 has an outer end 7 which projects from the valve 1 in an outward direction with respect to the container body 3 and has an inner end portion 8 projecting from the valve 1 in an inward direction with respect to the container 2, the valve 1 having a generally cylindrical body 9 defining an axis of symmetry 10 along which the stem 6 is reciprocatingly slidable.

The valve body 9 has an external surface 11 which is stepped in diameter so as to progressively decrease in size in the inward axial direction with respect to the container 2. A generally tubular elastomeric sleeve 12 having a tubular sidewall 38 coaxially overlays the body 9. The sleeve 12 fits sealingly around an outer end 13 of the body 9.

An annular shoulder portion 16 of the sleeve 12 is formed by a thickening of the sleeve material at the inner end 17 of the sidewall 38 such that the shoulder portion extends radially inwardly with respect to the axis 10 into contact with the inner end 15 of the body. Because of the stepped taper of the external surface 11, an annular chamber 14 is defined between the sleeve 12 and the external surface intermediate the outer end 13 and the inner end 15 of the body. The shoulder portion 16 is contoured to nestably receive the inner end 15 of the body and in this way the sleeve 12 is positively located in coaxial alignment with the body 9.

The annular chamber 14 is thereby closed at its innermost end with respect to the container 2 by the annular shoulder 16.

An internal chamber 18 is defined within the body 9 and extends axially from an outlet aperture 19 through which the outer end 7 of the stem extends and an inlet aperture 20 through which the inner end portion 8 of the stem extends. An outlet valve means 33 is formed in the outlet aperture 19 by a radially outwardly projecting annular flange 22 of the stem 6 co-operating with an annular elastomeric seal 23 which is held in sealing contact with the body 9 by the valve ferrule 5. A radially extending bore 24 of the stem communicates with an axially extending outlet channel 25 within the stem, the bore 24 being disposed outside of the internal chamber 18 in the closed condition of valve 1 as shown in FIG. 1 in which the position of the stem is such that the bore is overlaid by the seal 23. The seal 23 not only prevents leakage of fluid from the internal chamber 18 around the stem 6 but also prevents the bore 24 from communicating directly with the atmosphere. This prevents any deterioration of product fluid trapped in the stem 6 when the apparatus is not in use and also prevents leakage or drain back from the stem on to the exterior of the ferrule 5. The stem 6 is biassed outwardly by a helical spring 26 held in compression between the stem flange 22 and a shoulder 27 formed in the internal chamber 18.

An inlet valve means 21 comprises a tubular extension 28 of the sleeve 12 having a radially inwardly projecting rib 29 which is dimensioned to provide a sealing fit around the stem 6. The inner end portion 8 of the stem 6 is reduced in diameter such that an annular opening 30 is formed between the stem 6 and the rib 29 (and therefore the inlet valve means 21 is in an open condition) when the valve 1 is in a closed condition as shown in FIG. 1.

An axially extending slot 31 is formed in the inner end 15 of the body 9 and the slot extends axially to a greater extent than the annular shoulder portion 16 of the sleeve so as to communicate with the annular chamber 14. The slot 31 has an inner end portion 32 which extends radially into communication with the internal chamber 18 at a location which is adjacent to the inlet valve means 21. The internal chamber 18 is of reduced diameter at this location but axially extending spacer ribs 34 are provided within the internal chamber 18 and project radially inwardly to maintain clearance between the stem 6 and the internal chamber walls. The spacer ribs 34 also serve to maintain the stem 6 in alignment with the axis 10.

The sleeve 12 has at its outer end 35 a radially outwardly extending annular flange 36 which serves as a gasket means between a radially outwardly extending flange 37 of the body 9 and the rim 4 of the container 2. The cylindrical sidewall 38 of the sleeve 12 extends between the flange 36 and the shoulder portion 16. The flange 36, the sidewall 38, the shoulder 16 and the extension 28 including the rib 29 are all integrally formed of an elastomeric material which may be a natural or synthetic rubber or may be a thermoplastic elastomer. The radial thickness of the shoulder 16 is 1.4 millimeters compared with the much thinner thickness on the extension 28 which is 0.5 millimeters. Consequently the shoulder 16 is relatively rigid whereas the extension 28 is relatively flexible. The rib 29 projects radially inwardly by 0.54 millimeters from the extension 28. The radial thickness of the sidewall 38 is 0.55 millimetre so that the sidewall is relatively flexible. This flexibility allows the annular chamber 14 to be collapsible by radially inward deformation of the sidewall 38. The rib 29 is of semi circular cross section and in its relaxed state has an internal diameter which is slightly less than the diameter of the stem 6 but greater than the diameter of the inner end portion 8.

Figure 2:
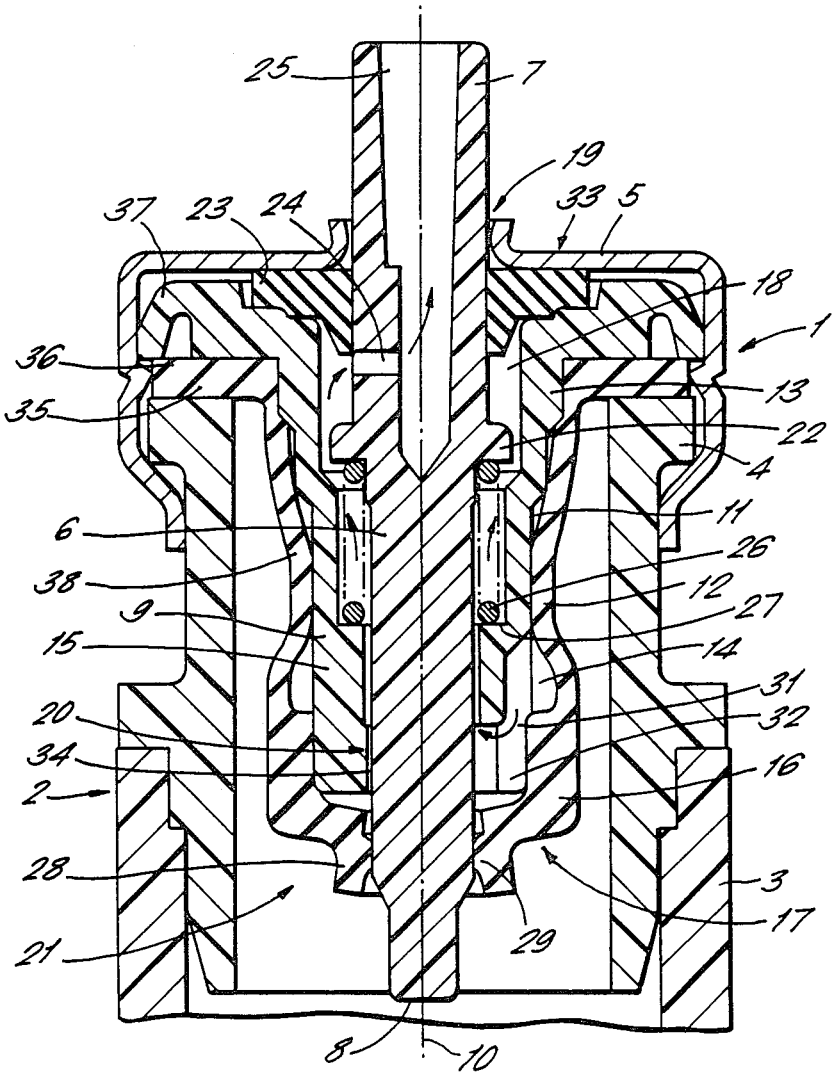
FIG. 2 is a similar view of the valve of FIG. 1 in the open condition.

FIG. 2. shows the valve in the open condition in which the stem 6 is depressed inwardly with respect to the container 2 such that the bore 24 communicates with the internal chamber 18 to thereby open the outlet valve means 33. In this condition the depressed stem 6 makes sealing contact with the rib 29 of the extension 28 such that the inlet valve means 21 is in a closed condition. Penetration of the stem through the rib 29 is accommodated by resilient deformation of the extension 28.

In use the container body 3 is charged with a pressurised fluid to be dispensed and once the valve 1 has been primed by an initial priming stroke of the valve stem the internal chamber !8 and the annular chamber 14 become filled with fluid.

When the stem 6 is depressed inwardly with respect to the container 2 such that the valve 1 is in the open condition, the internal chamber 18 is vented to atmospheric pressure and a flow of fluid commences from the internal chamber through the bore 24 to be dispensed through the outlet channel 25. This reduction of pressure within the chamber 18 is communicated through the slot 31 to the annular chamber 14 so that a pressure differential is established across the sidewall 38 which collapses radially inwardly towards the body 3 as shown in FIG. 2 thereby displacing fluid from the annular chamber through the slot and into the internal chamber 18. An equilibrium condition will then be reached in which further deformation of the sidewall 38 is prevented by contact with the body 3 and the flow of fluid is arrested. The valve stem is then released and returns under spring pressure to its normal position as shown in FIG. 1 and in doing so closes the outlet valve means 33 and opens the inlet valve means 21. The sleeve sidewall 38 then relaxes to its cylindrical undeformed shape and in doing so creates suction within the annular chamber 14. A refill flowpath is at the same time established from within the container 2, through the annular opening 30 around inner end portion 8 of the stem 6, into the internal chamber 18 at a location adjacent to the inlet valve means 21 and through the slot 31 to recharge the annular chamber 14 with fluid. An equilibrium condition will then be reached in which pressure is equalised on either side of the sidewall 38 and the refill flow ceases. The valve is then ready for further actuation.

It has been found that during repeated actuation of the valve 1, the quantity of fluid dispensed at each actuation remains substantially constant. By adjusting the dimensions of the annular chamber 14 it is possible to adjust the dispensed quantity so that a predetermined metered dose is dispensable.

Alternative embodiments of the invention are envisaged in which the seal 23 of the outlet valve means 33 comprises a double seat arrangement (not shown) in which two axially spaced valve seats are integrally formed in a sealing component. Such an arrangement provides additional protection against external contamination of the product.

The valve has application in pressurised dispensing containers which are required to operate at any orientation since the metered quantity dispensed is independent of valve orientation. The valve therefore has particular application to dispensers for nasal administration of medicinal products.

I claim:

1. A collapsible chamber metering valve for use in a pressurised dispensing container comprising a generally cylindrical body, an elastomeric sleeve coaxially overlaying the body and defining a collapsible chamber therebetween, the body defining an internal chamber, channel means providing a fluid flowpath between the internal chamber, and the collapsible chamber, an axially slidable valve actuating stem extending coaxially through the internal chamber, outlet valve means operable between the stem and the body at the outer end of the internal chamber so as to dispense fluid therefrom in an open condition of outlet valve means and inlet valve means operable between the sleeve and the stem at the inner end of the collapsible chamber to admit fluid thereto in a closed condition of outlet valve means wherein the inlet valve means comprises an annular, seal portion of the sleeve co-operating with an inner end portion of the stem extending therethrough and, wherein the sleeve further comprises an annular shoulder portion nestably receiving the inner end of the body, the shoulder portion and the seal portion being integrally formed of relatively thick and thin material respectively whereby the shoulder portion and seal portion are relatively rigid and flexible respectively so as to positively locate the sleeve upon the valve body whilst permitting deformation of the seal portion.

2. A valve as claimed in claim 1 in which the sleeve further comprises a radially outwardly extending annular flange at its outer axial extremity, which flange provides sealing gasket means in use between a similarly extending flange of the body and a rim of the container.

3. A valve as claimed in claim 1 in which the channel ,means comprises a slot in the body extending axially from the inner end of the body into communication with the collapsible chamber, at least the inner end portion of the slot extending radially into the internal chamber to provide a flowpath between the collapsible chamber and a location in the internal chamber adjacent to the inlet valve means.

4. A valve as claimed in claim 1 in which the seal portion of the sleeve comprises a tubular projection having a radially inwardly directing annular rib of part circular cross-section.

* * * * *